US010655886B2

(12) United States Patent
Ikeda et al.

(10) Patent No.: US 10,655,886 B2
(45) Date of Patent: May 19, 2020

(54) AIR CONDITIONER AND ITS OPERATING METHOD

(71) Applicant: Shinwa Controls Co., Ltd., Kawasaki-Shi (JP)

(72) Inventors: Yosuke Ikeda, Kawasaki (JP); Hideaki Furumoto, Kawasaki (JP); Hirofumi Komori, Kawasaki (JP); Takuya Ishimatsu, Kawasaki (JP)

(73) Assignee: Shinwa Controls Co., Ltd., Kawasaki-Shi (JP)

( * ) Notice: Subject to any disclaimer, the term of this patent is extended or adjusted under 35 U.S.C. 154(b) by 173 days.

(21) Appl. No.: 15/749,967

(22) PCT Filed: Aug. 1, 2016

(86) PCT No.: PCT/JP2016/072490
§ 371 (c)(1),
(2) Date: Feb. 2, 2018

(87) PCT Pub. No.: WO2017/026310
PCT Pub. Date: Feb. 16, 2017

(65) Prior Publication Data

US 2018/0238580 A1 Aug. 23, 2018

(30) Foreign Application Priority Data

Aug. 7, 2015 (JP) ..... 2015-157734

(51) Int. Cl.
*F24F 11/00* (2018.01)
*F24F 11/84* (2018.01)
(Continued)

(52) U.S. Cl.
CPC ..... *F24F 11/84* (2018.01); *F24F 11/49* (2018.01); *F24F 11/72* (2018.01); *F24F 11/89* (2018.01);
(Continued)

(58) Field of Classification Search
CPC .. F24F 11/84; F24F 11/72; F24F 11/89; F24F 2110/20; F24F 2110/10; F24F 2140/10;
(Continued)

(56) References Cited

U.S. PATENT DOCUMENTS 9,562,700 B2 * 2/2017 Watanabe ..... F24F 3/153
2008/0098756 A1 * 5/2008 Uselton ..... F24F 3/153 62/173
2013/0139996 A1 6/2013 Hashimoto

FOREIGN PATENT DOCUMENTS

JP H01-160275 U 11/1989
JP 2001-012808 A1 1/2001
(Continued)

OTHER PUBLICATIONS

English translation of International Preliminary Report on Patentability (Chapter I) (Application No. PCT/JP2016/072490) dated Feb. 13, 2018, 5 pages.
(Continued)

*Primary Examiner* — Frantz F Jules
*Assistant Examiner* — Lionel Nouketcha
(74) *Attorney, Agent, or Firm* — Burr & Brown, PLLC

(57) ABSTRACT

An air conditioner includes: a cooling unit having a compressor operated at a variable operating frequency to adjust a revolving speed thereof, a condenser, an expansion valve and a cooling coil; and a heating unit for causing the heating medium flowing from the compressor toward the condenser to diverge, and to return to flow into the condenser, through a heating coil and a thermal dose adjusting valve disposed on the downstream side thereof; so as to control a temperature of air by the cooling and heating coils. When an opening manipulated variable of the thermal dose adjusting valve exceeds a first threshold value over a period of time, an operating frequency of the compressor is decreased, and when the opening manipulated variable of the thermal dose
(Continued)

adjusting valve falls below a smaller, second threshold value, over the said period of time, the operating frequency of the compressor is increased.

12 Claims, 3 Drawing Sheets

(51) Int. Cl.

| | |
|---|---|
| ***F24F 11/89*** | (2018.01) |
| ***F24F 11/49*** | (2018.01) |
| ***F24F 11/72*** | (2018.01) |
| *F24F 110/20* | (2018.01) |
| *F24F 110/40* | (2018.01) |
| *F24F 140/10* | (2018.01) |
| *F24F 110/10* | (2018.01) |

(52) U.S. Cl.
CPC ..... *F24F 2110/10* (2018.01); *F24F 2110/20* (2018.01); *F24F 2110/40* (2018.01); *F24F 2140/10* (2018.01); *F24F 2203/021* (2013.01); *F25B 2400/0403* (2013.01); *F25B 2400/0405* (2013.01); *F25B 2600/0253* (2013.01); *F25B 2600/2501* (2013.01)

(58) Field of Classification Search
CPC ..... F25B 2400/0403; F25B 2400/0405; F25B 2600/0253; F25B 2600/2501
See application file for complete search history.

(56) References Cited

FOREIGN PATENT DOCUMENTS

| | | | | |
|---|---|---|---|---|
| JP | 2002-286301 | A1 | | 10/2002 |
| JP | 2010-230184 | A1 | | 10/2010 |
| JP | 2010230184 | A | * | 10/2010 |
| JP | 2011-133170 | A1 | | 7/2011 |
| JP | 2013-108652 | A1 | | 6/2013 |

OTHER PUBLICATIONS

English translation of H01-160275 U, 14 pages.
Japanese Office Action (Application No. 2015-157734) dated Oct. 20, 2015 (with English translation).
International Search Report and Written Opinion (Application No. PCT/JP2016/072490) dated Oct. 25, 2016.

* cited by examiner

AIR CONDITIONER AND ITS OPERATING METHOD

FIELD OF THE INVENTION

The present invention relates to an air conditioner and its operating method.

BACKGROUND ART

An indoor temperature of a cleanroom in a semiconductor manufacturing plant is strictly managed by an air conditioner. For example, an indoor temperature of a clean room, in which an apparatus (such as coater) for coating and developing a photoresist is installed, is sometimes required to be controlled within an error range of between +0.05° C. and −0.05° C. relative to a target temperature. Various air conditioners suited for such a cleanroom have been conventionally proposed (see Patent Document 1, for example).

Patent Document 1: 3P2013-108652A

SUMMARY OF THE INVENTION

An air conditioner of this type generally includes: a cooling unit in which a compressor, a condenser, an expansion value and a cooling coil are connected in this order by pipes in order to circulate a heating medium; and a heater. As the compressor of the cooling unit, a compressor that is driven at a constant revolving speed is used in general. This is because, due to the compressor that is driven at a constant revolving speed, a heating medium in the cooling unit can be basically circulated at a constant flow rate, whereby it is easy to preform an air temperature control with a high degree of accuracy.

However, even if a temperature of air whose temperature is to be controlled is lower than a target temperature so that no cooling capacity (refrigeration capacity) for cooling the air is needed, the compressor that is driven at a constant revolving speed is always driven at a constant speed. Thus, since there is a possibility that power is inefficiently consumed, there is a room for improving power saving. In addition, the cooling capacity can be varied by adjusting an opening of the expansion valve or the like, but its variable range is relatively small, and thus service conditions (application conditions) may be disadvantageously restricted.

On the other hand, in an air conditioner for domestic use, a compressor, which is operated at a variable operating frequency so that a revolving speed thereof is adjustable, is often controlled by an inverter, with a view to saving power. Since a cooling capacity of such an air conditioner can be adjusted within a relatively broad range by varying the operating frequency, it can be said that such an air conditioner can be applied to various service conditions. However, since the cooling capacity varies in accordance with the variation of the operating frequency, the air conditioner is not suited for a highly accurate temperature control. Thus, such a compressor is rarely employed in an air conditioner for a cleanroom and so on, while it has various advantages such as power-saving feature, etc.

The present invention has been made in view of these circumstances. The object of the present invention is to provide, by utilizing a compressor which is operated at a variable operating frequency so that a revolving speed thereof is adjustable, an air conditioner and its operating method, the air conditioner being capable of being reduced in size, of being simplified and of saving power while being suited for wide range of service conditions, on the other hand, the air conditioner being capable of controlling a temperature of air whose temperature is to be controlled to a desired temperature with a high degree of accuracy.

The present invention is an air conditioner comprising:

a cooling unit in which a compressor which is operated at a variable operating frequency so that a revolving speed thereof is adjustable, a condenser, an expansion valve, and a cooling coil are connected in this order by pipes in order to circulate a heating medium;

a heating unit which causes a part of the heating medium flowing out from the compressor toward the condenser to diverge, and causes it to return to flow into the condenser on a downstream side of the compressor, through a heating coil and a thermal dose adjusting valve disposed on the downstream side thereof;

an air passage path which accommodates the cooing coil and the heating coil, and is provided with an inlet for taking in an air whose temperature is to be controlled, and an outlet for ejecting the air whose temperature is to be controlled;

a blower which causes air to flow from the inlet to the outlet;

a first temperature sensor disposed on the outlet;

a second temperature sensor disposed in a use area to which air ejected from the outlet is supplied;

a pressure sensor which detects a pressure in the pipe on the downstream side of the cooling coil; and a control unit which controls the operating frequency of the compressor, an opening of the expansion valve, and an opening of the thermal dose adjusting valve;

wherein the control unit includes:

a heating medium pressure control part which calculates, by means of a PID calculation based on a difference between a pressure detected by the pressure sensor and a preset target pressure, an opening manipulated variable of the expansion valve for conforming the pressure detected by the pressure sensor to the target pressure, and controls the opening of the expansion valve in accordance with the opening manipulated variable;

a thermal dose control part which sets a target source temperature of the air whose temperature is to be controlled passing through the outlet, based on a difference between a temperature detected by the second temperature sensor and a target use temperature preset for the use area; calculates, by means of a PID calculation based on a difference between a temperature detected by the first temperature sensor and the target source temperature, an opening manipulated variable of the thermal dose adjusting valve for conforming the temperature detected by the first temperature sensor to the target source temperature; and controls the opening of the thermal dose adjusting valve in accordance with the opening manipulated variable; and a compressor control part which adjusts the revolving speed of the compressor; by decreasing the operating frequency of the compressor by a predetermined frequency when the opening manipulated variable of the thermal dose adjusting valve, which is calculated by the thermal dose control part, exceeds a first threshold value over a predetermined period of time which is set between 10 seconds and 30 seconds; and by increasing the operating frequency of the compressor by the predetermined frequency when the opening manipulated variable of the thermal dose adjusting valve, which is calculated by the thermal dose control part, falls below a second threshold value, which is smaller than the first threshold value, over the predetermined period of time; and wherein the thermal dose control part calculates, as the opening manipulated variable of the thermal dose adjusting valve, a moving average value of the manipulated variable calculation values of the thermal dose adjusting valve, which are directly calculated by means of the PID calculation based on the difference between the temperature detected by the first temperature sensor and the target source temperature, with an interval at which the moving average value is calculated being set in a range of from 1/10 to 6/10 of the predetermined period of time.

According to the present invention, the following operational effects can be obtained.

(1) By utilizing the compressor which is operated at a variable operating frequency so that a revolving speed thereof is adjustable, the revolving speed of the compressor can be varied. Thus, even under conditions of a usage environment and target temperatures (target use temperature, target source temperature) that are broadly set, a sufficiently broad cooling capacity for controlling a temperature of air whose temperature is to be controlled toward a target temperature can be obtained by the single compressor. In addition, when the cooling capacity is not so needed, power can be saved by decreasing the operating frequency. Thus, the air conditioner can be small and simple and is capable of saving power while being suited for greater service conditions.

(2) The heating unit employs the structure configured to cause a part of the heating medium flowing out from the compressor toward the condenser to diverge and to cause it to return to flow into the condenser on the downstream side of the compressor, through the heating coil and the thermal dose adjusting valve disposed on the downstream side thereof. Thus, the accuracy in controlling a temperature to a target temperature can be improved, and the air conditioner can be simplified as a whole because of the simple thermal does adjusting valve.

Namely, unlike the present invention, when a valve for adjusting a flow rate is disposed on the upstream side of the heating coil, the valve controls the gaseous heating medium having a high temperature and a high pressure, coming from the compressor. It is more difficult to accurately control a flow rate of a gaseous heating medium than to control a flow rate of a liquid heating medium. Moreover, a robust structure that can withstand a high-temperature and high-pressure heating medium is needed. On the other hand, in the present invention, since the thermal dose adjusting valve is disposed on the downstream side of the heating coil, the thermal dose adjusting valve can control a flow rate of the heating medium that has passed through the heating coil so as to be liquefied. Furthermore, since the heating medium has a lowered temperature, even the thermal dose adjusting valve of a relatively simple structure can withstand the temperature of the heating medium. Thus, the accuracy in controlling a temperature to a target temperature can be improved, and the air conditioner can be simplified as a whole because of the simple thermal does adjusting valve.

(3) In addition, according to the structure in which a part of the heating medium having passed through the heating coil is returned to the downstream side of the compressor (upstream side of the condenser), the heating medium, which has passed through the heating coil so as to be liquefied, returns to the condenser. Thus, the heating medium, which has passed through the heating coil so as to be liquefied, can be prevented from flowing into the compressor, whereby the air conditioner can be smoothly operated. As a result, the accuracy in controlling a temperature to a target temperature can be improved.

Namely, unlike the present invention, when the heating medium, which has passed through the heating coil so as to be liquefied, flows into the compressor, a so-called liquid back phenomenon occurs. In the liquid back phenomenon, a lubrication oil supplied to a movable part in the compressor may flow out, which invites seizure. In addition, since the compressor compresses the liquid, the operation stability of the compressor may be impaired. On the other hand, in the present invention, since the heating medium is returned to the downstream side of the compressor, it is possible to prevent the seizure of a member in the compressor and the unstable operation of the compressor. As a result, the air conditioner can be smoothly operated, whereby the accuracy in controlling a temperature to a target temperature can be improved.

(4) In addition, the heating medium pressure control part calculates, by means of a PID calculation based on a difference between a pressure detected by the pressure sensor and a preset target pressure, an opening manipulated variable of the expansion valve for conforming the pressure detected by the pressure sensor to the target pressure, and controls the opening of the expansion valve in accordance with the opening manipulated variable. Thus, since the temperature of the heating medium flowing out from the cooling coil can be stabilized, the cooling capacity is made stable. Thus, the accuracy in controlling a temperature to a target temperature can be improved.

(5) In addition, the thermal dose adjusting part sets a target source temperature of the temperature control air passing through the outlet, based on a difference between a temperature detected by the second temperature sensor and a target use temperature preset for the use area; calculates, by means of a PID calculation based on a difference between a temperature detected by the first temperature sensor and the target source temperature, an opening manipulated variable of the thermal dose adjusting valve for conforming the temperature detected by the first temperature sensor to the target source temperature; and controls the opening of the thermal dose adjusting valve in accordance with the opening manipulated variable. Thus, by taking into consideration of influences of disturbance and responsibility when the temperature control air (the air whose temperature is to be controlled) having passed through the outlet reaches the use area, it is possible to obtain a right opening manipulated variable of the thermal dose adjusting valve for conforming a temperature of the use area to the target use temperature by means of the temperature control air. Thus, the accuracy in controlling a temperature to a target temperature (target use temperature) can be improved.

(6) In addition, the compressor control part adjusts the revolving speed of the compressor; by decreasing the operating frequency of the compressor by a predetermined frequency, when the opening manipulated variable of the thermal dose adjusting valve exceeds a first threshold value over a predetermined period of time, and by increasing the operating frequency of the compressor by the predetermined frequency, when the opening manipulated variable of the thermal dose adjusting valve falls below a second value, which is smaller than the first threshold value, over the predetermined period of time. Thus, when the opening manipulated variable of the thermal dose adjusting valve exceeds the first threshold value over the predetermined period of time, the compressor control part judges that the cooling capacity is excessive, and the compressor control part decreases the operating frequency of the compressor to decrease the revolving speed, whereby the cooling capacity can be decreased. On the other hand, when the opening manipulated variable of the thermal dose adjusting valve falls below the second threshold value, which is smaller than the first threshold value, over the predetermined period of time, the compressor control part judges that the cooling capacity is insufficient, and the compressor control part increases the operating frequency of the compressor to increase the revolving speed, whereby the cooling capacity can be increased. Thus, a temperature of air whose temperature is to be controlled can be appropriately controlled.

In particular, since whether to increase or decrease the operating frequency of the compressor is judged based on a behavior of the opening manipulated variable of the thermal dose adjusting valve in the predetermined period of time after the predetermined period of time has elapsed, the operating frequency of the compressor is varied in a stepwise manner, and the operating frequency can be prevented from being abruptly varied. Thus, a disturbance influence caused by variation in cooling capacity and heating capacity in accordance with the variation in operating frequency can be restrained. Thus, the accuracy in controlling a temperature to a target temperature can be improved.

For the foregoing reasons, according to the present invention, by utilizing the compressor which is operated at a variable operating frequency so that a revolving speed thereof is adjustable, it is possible to achieve an air conditioner being capable of being reduced in size, of being simplified and of saving power while being suited for wide range of service conditions, on the other hand, the air conditioner being capable of controlling a temperature of air to be controlled to a desired temperature with a high degree of accuracy.

The air conditioner according to the present invention may further comprises: a humidifier which adjusts a humidity of the air whose temperature is to be controlled, the humidifier being disposed on the downstream side of the heating coil in the air passage path; and a humidity sensor disposed on the outlet; wherein the control unit further includes a humidification control part which calculates, by means of a PID calculation based on a difference between a humidity detected by the humidity sensor and a preset target humidity, a humidification manipulated variable for conforming the humidity detected by the humidity sensor to the target humidity, and controls the humidifier in accordance with the humidification manipulated variable.

In addition, the present invention is an air conditioner operating method, the air conditioner comprising: a cooling unit in which a compressor which is operated at a variable operating frequency so that a revolving speed thereof is adjustable, a condenser, an expansion valve, and a cooling coil are connected in this order by pipes in order to circulate a heating medium; a heating unit which causes a part of the heating medium flowing out from the compressor toward the condenser to diverge, and causes it to return to flow into the condenser on a downstream side of the compressor, through a heating coil and a thermal dose adjusting valve disposed on the downstream side thereof; an air passage path which accommodates the cooing coil and the heating coil, and is provided with an inlet for taking in an air whose temperature is to be controlled, and an outlet for ejecting the air whose temperature is to be controlled; a blower which causes air to flow from the inlet to the outlet; a first temperature sensor disposed on the outlet; and a second temperature sensor disposed in a use area to which air ejected from the outlet is supplied;

the air conditioner operating method comprising:

a heating medium pressure control step which calculates, by means of a PID calculation based on a difference between a pressure detected by a pressure sensor, which detects a pressure in the pipe on the downstream side of the cooling coil in the air passage path, and a preset target pressure, an opening manipulated variable of the expansion valve for conforming the pressure detected by the pressure sensor to the target pressure, and controls the opening of the expansion valve in accordance with the opening manipulated variable;

a thermal dose control step which sets a target source temperature of the air whose temperature is to be controlled passing through outlet, based on a difference between a temperature detected by the second temperature sensor and a target use temperature preset for the use area; calculates, by means of a PID calculation based on a difference between a temperature detected by the first temperature sensor and the target source temperature, an opening manipulated variable of the thermal dose adjusting valve for conforming the temperature detected by the first temperature sensor to the target source temperature; and controls the opening of the thermal dose adjusting valve in accordance with the opening manipulated variable; and a compressor control step which adjusts the revolving speed of the compressor; by decreasing the operating frequency of the compressor by a predetermined frequency when the opening manipulated variable of the thermal dose adjusting valve, which is calculated in the thermal dose control step, exceeds a first threshold value over a predetermined period of time which is set between 10 seconds and 30 seconds; and by increasing the operating frequency of the compressor by the predetermined frequency when the opening manipulated variable of the thermal dose adjusting valve, which is calculated is the thermal dose control step, falls below a second threshold value, which is smaller than the first threshold value, over the predetermined period of time; and wherein the thermal dose control step calculates, as the opening manipulated variable of the thermal dose adjusting valve, a moving average value of the manipulated variable calculation values of the thermal dose adjusting valve, which are directly calculated by means of the PID calculation based on the difference between the temperature detected by the first temperature sensor and the target source temperature, with an interval at which the moving average value is calculated being set in a range of from 1/10 to 6/10 of the predetermined period of time.

In the air conditioner operating method according to the present invention, the air conditioner may be provided with a humidifier which adjusts a humidity of the air whose temperature is to be controlled, on the downstream side of the heating coil in the air passage path, and the air conditioner operating method may further comprise a humidification control step which calculates, by means of a PID calculation based on a difference between a humidity detected by a humidity sensor disposed on the outlet and a preset target humidity, a humidification manipulated variable of the humidifier for conforming the humidity detected by the humidity sensor to the target humidity, and controls the humidifier in accordance with the humidification manipulated variable.

According to the present invention, by utilizing a compressor which is operated at a variable operating frequency so that a revolving speed thereof is adjustable, it is possible to achieve an air conditioner being capable of being reduced in size, of being simplified and of saving power while being suited for wide range of service conditions, on the other hand, the air conditioner being capable of controlling a temperature of air to be controlled to a desired temperature with a high degree of accuracy.

DETAILED DESCRIPTION OF THE INVENTION

Figure 1:
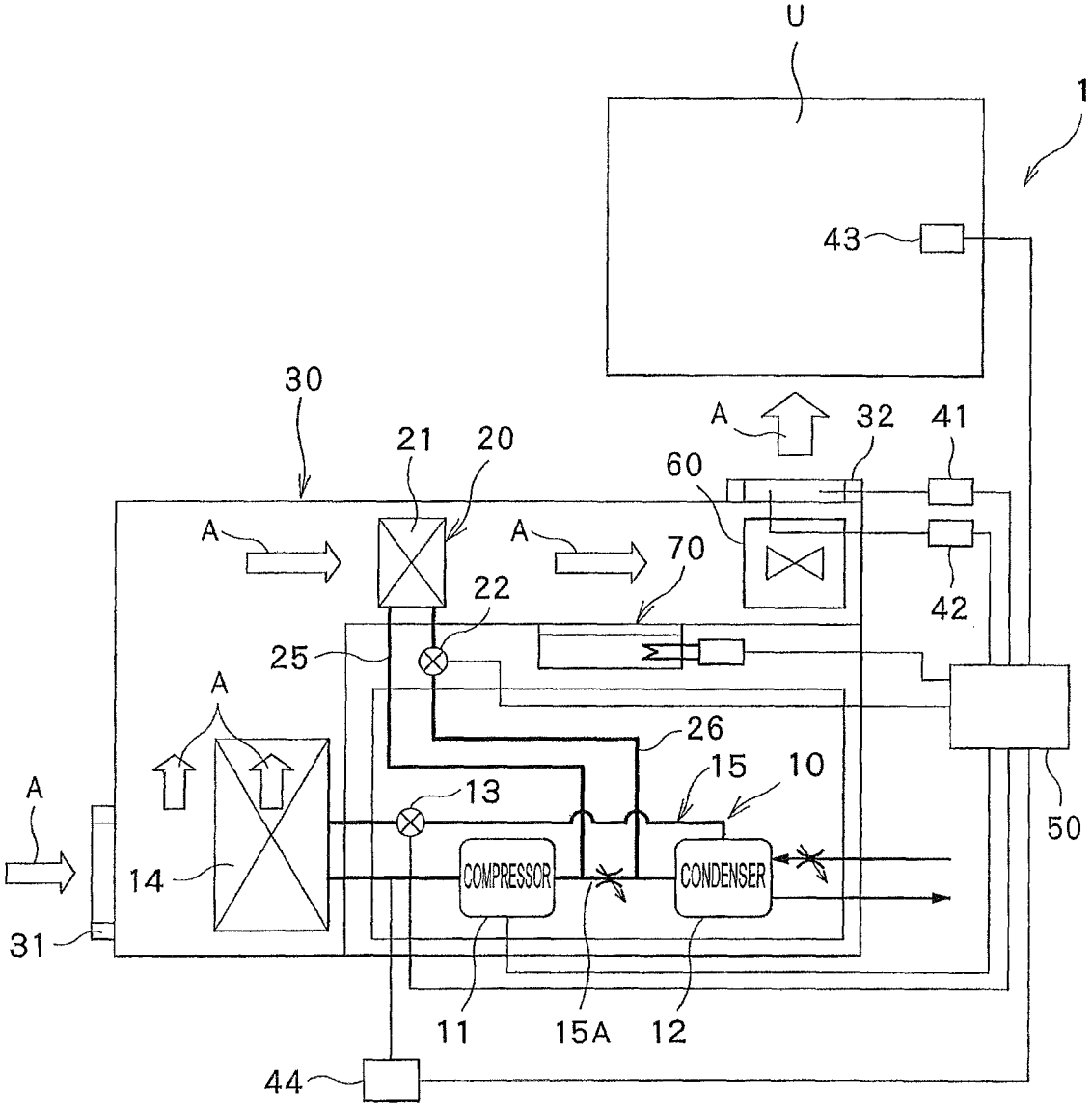
FIG. 1 is a schematic view of an air conditioner according to the present invention.

One embodiment of the present invention is described in detail below, with reference to the attached drawings. FIG. 1 is a schematic view of an air conditioner 1 according to the present invention. The air conditioner 1 in this embodiment is used to supply an apparatus for coating and developing a photoresist with air whose temperature is controlled, so as to maintain constant a temperature in the apparatus.

Firstly, a schematic structure of the air conditioner 1 in this embodiment is described.

As shown in FIG. 1, the air conditioner 1 includes: a cooling unit 10 in which a compressor 11 which is operated at a variable operating frequency so that a revolving speed thereof is adjustable, a condenser 12, an expansion valve 13 and a cooling coil 14 are connected in this order by pipes 15 in order to circulate a heating medium; a heating unit 20 which causes a part of the heating medium flowing out from the compressor 11 toward the condenser 12 to diverge, and causes it to return to flow into the condenser 12 on a downstream side of the compressor 11, through a heating coil 21 and a thermal dose adjusting valve 22 disposed on the downstream side thereof; an air passage path 30 which accommodates the cooling coil 14 and the heating coil 21, and is provided with an inlet 31 for taking in an air whose temperature is to be controlled (temperature control air), and an outlet 32 for ejecting the temperature control air; a blower 60 which causes air to flow from the inlet 31 to the outlet 32; a first temperature sensor 41 disposed on the outlet 32; a second temperature 43 disposed in a use area U to which air ejected from the outlet 32 is supplied; a pressure sensor 44 which detects a pressure in the pipe on the downstream side of the cooling coil 14; and a controller 50 which controls the operating frequency of the compressor 11, an opening of the expansion valve 13, and an opening of the thermal dose adjusting valve 22.

In addition, the air conditioner 1 according to this embodiment further includes a humidity sensor 42 which is disposed on the outlet 32, and a humidifier 70 which adjusts a humidity of the temperature control air, the humidifier 70 being disposed between the heating coil 21 and the blower 60 in the air passage path 30, i.e., on the downstream side of the heating coil 21. The humidity detected by the humidity sensor 42 is inputted to the controller 50. The controller 50 is also configured to adjust the humidifier 70 based on the humidity detected by the humidity sensor 42 so as to control the humidity of the temperature control air to a desired humidity.

Although FIG. 1 shows that the first temperature sensor 41 and the humidity sensor 42 are distant from the outlet 32 for the sake of illustration, the first temperature sensor 41 and the humidity sensor 42 are located in a given layout by which they can detect a temperature or a humidity of air passing through the outlet 32.

In FIG. 1, a plurality of arrows A show an air flow. As shown by the arrows A, in this air conditioner 1, after the air whose temperature is to be controlled having been taken into the air passage path 30 from the inlet 31 of the air passage path 30 has passed through the cooling coil 14 and the heating coil 21, the air is ejected from the outlet 32. The air ejected from the outlet 32 is supplied to the use area U. In this embodiment, the blower 60 is disposed in the air passage path 30 between the heating coil 21 and the outlet 32 (near the outlet 32 in the example of FIG. 1), so that the air having passed through the heating coil 21 is configured to be ejected from the outlet 32 to the use area U. The use area U is an internal space of, for example, an apparatus for coating and developing a photoresist (such as a coater).

In this air conditioner 1, the air whose temperature is to be controlled is cooled by the cooling coil 14 and heated by the heating coil 21, so that a temperature of the use area U is controlled to a preset target use temperature. A cooling capacity of the cooling coil 14 can be adjusted in accordance with an operating frequency of the compressor 11 and/or an opening of the expansion valve 13, while a heating capacity of the heating coil 21 can be adjusted in accordance with an operating frequency of the compressor 11 and/or an opening of the thermal dose adjusting valve 22. Adjusting operations of the cooling capacity and the heating capacity are performed by the aforementioned controller 50 which adjusts the operating frequency of the compressor 11, the opening of the expansion valve 13, and the opening of the thermal dose adjusting valve 22.

Respective structures of the air conditioner 1 are described in detail below.

In the cooling unit 10, the compressor 11 is configured to compress a gaseous heating medium having a low temperature and a low pressure, which has flowed out from the cooling coil 14, into a gaseous heating medium having a high temperature (e.g., 80° C.) and a high pressure, and is configured to supply it to the condenser 12. The compressor 11 is an inverter compressor which is operated at a variable operating frequency so that a revolving speed thereof is adjustable, in accordance with the operating frequency. In the compressor 11, when the operating frequency is increased, a larger amount of the heating medium is supplied to the condenser 12. As the compressor 11, a scroll type compressor having an inverter and a motor together is preferably employed. However, as long as a feed rate (flow rate) of the heating medium can be adjusted by adjusting the operating frequency by an inverter to adjust the revolving speed, the type of the compressor 11 is not particularly limited.

The condenser 12 is configured to cool and condense the heating medium compressed by the compressor 11 by means of cooling water into a liquid heating medium having a predetermined cooled temperature (e.g., 40° C.) and a high pressure, and is configured to supply it to the expansion valve 13. Water can be used as the cooling water of the condenser 12, or another coolant can be used. The expansion valve 13 is configured to expand the heating medium supplied from the condenser 12 to decompress it into a heating medium in a gas-liquid mixture state, which has a low temperature (e.g., 2° C.) and a low pressure, and is configured to supply it to the cooling coil 14. The cooling coil 14 is configured to heat-exchange the supplied heating medium with the air whose temperature is to be controlled so that the air is cooled. The heating medium having been heat-exchanged with the air becomes a gaseous heating medium having a low temperature and a low pressure, and the heating medium is configured to flow out from the cooling coil 14 so as to be again compressed by the compressor 11.

In such a cooling unit 10, a feed rate of the heating medium to be supplied to the condenser 12 can be adjusted by varying the operating frequency of the compressor 11 so as to adjust the revolving speed, as well as a feed rate of the heating medium to be supplied to the cooling coil 14 can be adjusted because the opening of the expansion valve 13 can be adjusted. Such adjustment enables the cooling capacity to be varied.

On the other hand, in the heating unit 20, the heating coil 21 has a heating medium entrance and a heating medium exit. The heating medium entrance and an upstream side of a pipe 15A between the compressor 11 and the condenser 12 are connected by a supply pipe 25. On the other hand, the heating medium exit and a downstream side of the pipe 15A are connected by a return pipe 26. The return pipe 26 is equipped with the thermal dose adjusting valve 22. Thus, the heating unit 20 can cause a pat of the heating medium flowing out from the compressor 11 toward the condenser 12 to diverge, and can cause it to return to flow into the condenser 12, through the heating coil 21 and the thermal dose adjusting valve 22.

In the heating unit 20, a gaseous heating medium, which has been compressed by the compressor 11 to have a high temperature (e.g., 80° C.) and a high pressure, is supplied to the heating coil 21. The heating coil 21 is configured to heat-exchange the supplied heating medium with the air whose temperature is to be controlled so as to heat the air. The heating medium, which has been heat-exchanged with the air, is configured to return from the heating coil 21 to the pipe 15A through the return pipe 26. By means of the thermal dose adjusting valve 22 which adjusts an amount of the heating medium returning from the heating coil 21 to the pipe 15A, a heating capacity of the heating coil 21 can be varied. The more the returning amount of the heating medium is, the more the heating capacity increases.

Figure 2:
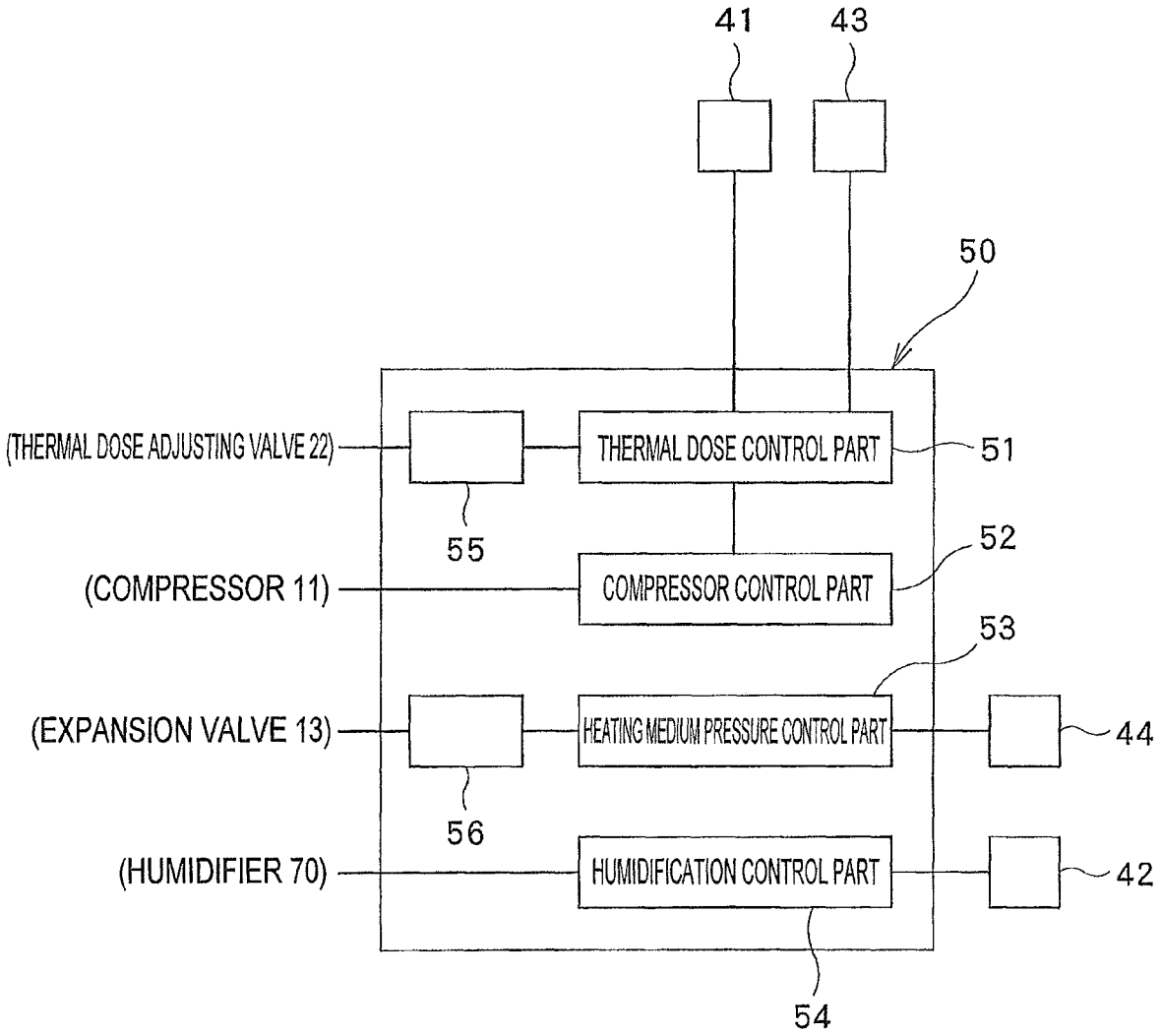
FIG. 2 is a block diagram of a control unit of the air conditioner of FIG. 1.

FIG. 2 is a block diagram of the controller 50. As shown in FIG. 2, the control unit 50 in this embodiment includes: a thermal dose control part 51 which controls the opening of the thermal dose adjusting valve 22; a compressor control part 52 which controls the operating frequency of the compressor 11; a heating medium pressure control part 53 which controls the opening of the expansion valve 13; a humidification control part 54 which controls the humidifier 70; a first pulse converter 55 connected to the thermal dose control part 51; and a second pulse converter 56 connected to the heating medium pressure control part 53. A target use temperature, which is a target temperature of the use area U, a target pressure of the heating medium in the cooling unit 10, and a target humidity of the temperature control air are inputted to the controller 50.

The thermal dose control part 51 is configured: to set a target source temperature of the air whose temperature is to be controlled passing through the outlet 32, based on a difference between a temperature detected by the second temperature sensor 43 and the target use temperature preset for the use area U; to calculate, by means of a PID calculation based on a difference between a temperature detected by the first temperature sensor 41 and the aforementioned target source temperature, an opening manipulated variable of the thermal dose adjusting valve 22 for conforming the temperature detected by the first temperature sensor 41 to the aforementioned target source temperature; and to control (PID control) the opening of the thermal dose adjusting valve 22 in accordance with the opening manipulated variable. The opening manipulated variable means the opening of the thermal dose adjusting valve 22. When the thermal dose adjusting valve 22 is full closed, a value of the opening manipulated variable is 0%, and when full opened, a value thereof is 100%.

In more detail, the thermal dose control part 51 in this embodiment outputs the calculated opening manipulated variable to the first pulse converter 55, and the pulse converter 55 calculates a pulse signal corresponding to the opening manipulated variable and transmits it to the thermal dose adjusting valve 22. Thus, the opening of the thermal dose adjusting valve 22 is adjusted to the calculated opening manipulated variable. Although not shown, the opening of the thermal dose adjusting valve 22 is adjusted by a stepper motor that is driven in accordance with the pulse signal from the first pulse converter 55. The aforementioned target source temperature is a temperature by which a temperature of the use area U can reach the target use temperature, when the temperature control air is supplied to the use area U. A relationship between the target source temperature and the target use temperature may be specified by a calculation or an experiment, based on a positional relationship between the air conditioner 1 and the use area U, etc.

In addition, after the thermal dose control part 51 in this embodiment has directly calculated the manipulated variable calculation values of the thermal dose adjusting valve 22 by means of the PID calculation based on the difference between the temperature detected by the first temperature sensor 41 and the target source temperature, the thermal dose control part 51 is configured to calculate, as the aforementioned opening manipulated variable of the thermal dose adjusting valve 22, a moving average value of the manipulated variable calculation values.

When observed in a chronological order, the manipulated variable calculation values, which are directly calculated by means of the PID calculation, are sometimes calculated to include a lot of harmonics. When the manipulated variable calculation values observed as such harmonics are handled as actual manipulated variables, a control system may be disturbed. Thus, in this embodiment, in order to restrain an influence of the manipulated variable calculation values observed as harmonics, a moving average value of the manipulated variable calculation value is calculated as the aforementioned opening manipulated variable of the thermal dose adjusting valve 22. Thus, the control can be stabilized.

Following thereto, the compressor control part 52 is configured to adjust the revolving speed of the compressor 11; by decreasing the operating frequency of the compressor 11 by a predetermined frequency when the aforementioned opening manipulated variable of the thermal dose adjusting valve 22 exceeds a first threshold value over a predetermined period of time; and by increasing the operating frequency of the compressor 11 by the predetermined frequency when the aforementioned opening manipulated variable of the thermal dose adjusting valve 22 falls below a second value, which is smaller than the first threshold value, over the predetermined period of time.

According to the compressor control part 52, when the opening manipulated variable of the thermal dose adjusting valve 22 exceeds the first threshold value over the predetermined period of time, the compressor control part 52 judges that the cooling capacity is excessive, and the compressor control part 52 decreases the operating frequency of the compressor 11 to decrease the revolving speed, whereby the cooling capacity can be decreased. On the other hand, when the opening manipulated variable of the thermal dose adjusting valve 22 falls below the second threshold value, which is smaller than the first threshold value, over the predetermined period of time, the compressor control part 52 judges that the cooling capacity is insufficient, and the compressor control part 52 increases the operating frequency of the compressor 11 to increase the revolving speed, whereby the cooling capacity can be increased. Thus, a temperature of air whose temperature is to be controlled can be appropriately controlled.

The compressor control part 52 in this embodiment is configured to perform the judgment of whether to increase or decrease the operating frequency of the compressor 11 based on a behavior of the opening manipulated variable of the thermal dose adjusting valve 22 in the predetermined period of time after the predetermined period of time has elapsed. Such a process is performed such that the operating frequency of the compressor 11 is not frequently varied, in order to improve the control accuracy by restraining a disturbance influence on the control system caused by variation in cooling capacity and heating capacity. The above "predetermined period of time" is a value that is variable depending on characteristics of the air conditioner 1, but is preferably set between 10 seconds and 30 seconds, preferably between 15 seconds and 25 seconds, and more preferably 20 seconds, for example, in consideration of a practical time required to reach the target use temperature without frequently varying the operating frequency of the compressor 11.

In addition, as described above, the thermal dose control part 51 calculates the opening manipulated variable as the moving average value of the manipulated variable calculation values directly calculated. An interval at which the moving average value is calculated is a time shorter than the aforementioned "predetermined period of time". For example, the interval at which the moving average value is calculated may be set in a range of from 1/10 to 6/10 of the aforementioned "predetermined period of time". To be specific, the thermal dose control part 51 in this embodiment calculates, as the opening manipulated variable of the thermal dose adjusting valve 22, a moving average value of the manipulated variable calculation values of the thermal dose adjusting valve 22, which are directly calculated by means of the PID calculation based on the difference between the temperature detected by the first temperature sensor 41 and the target source temperature, with an interval at which the moving average value is calculated being set between 1/10 and 6/10 of the aforementioned "predetermined period of time".

In addition, according to the control of the compressor control part 52, the opening of the thermal dose adjusting valve is tend to converge between the aforementioned "first threshold value" and the "second threshold value", as the control of a temperature to the target use temperature becomes stable. In the case where the opening converges, when the opening of the thermal dose adjusting valve 22 has a relatively large value, such a large opening is not preferable in terms of power saving. Thus, although the "first threshold value" and the "second threshold value" are values that are variable depending on characteristics of the air conditioner 1, they are preferably set between 5 and 30%, on the assumption that the full open state of the opening of the thermal dose adjusting valve 22 is 100%.

Further, the "predetermined frequency" by which the thermal dose control part 51 increases or decreases the operating frequency of the compressor 11 in accordance with the opening manipulated variable is preferably a relatively small value, from the viewpoint of restraining a disturbance influence on the control system caused by variation in cooling capacity and heating capacity. This "predetermined frequency" is a value that is variable depending on characteristics of the air conditioner and a type of the motor of the compressor 11, but is preferably set about 1 Hz to 4 Hz, for example, in consideration of a practical time required to reach the target use temperature without frequently varying the operating frequency of the compressor 11.

Figure 3:
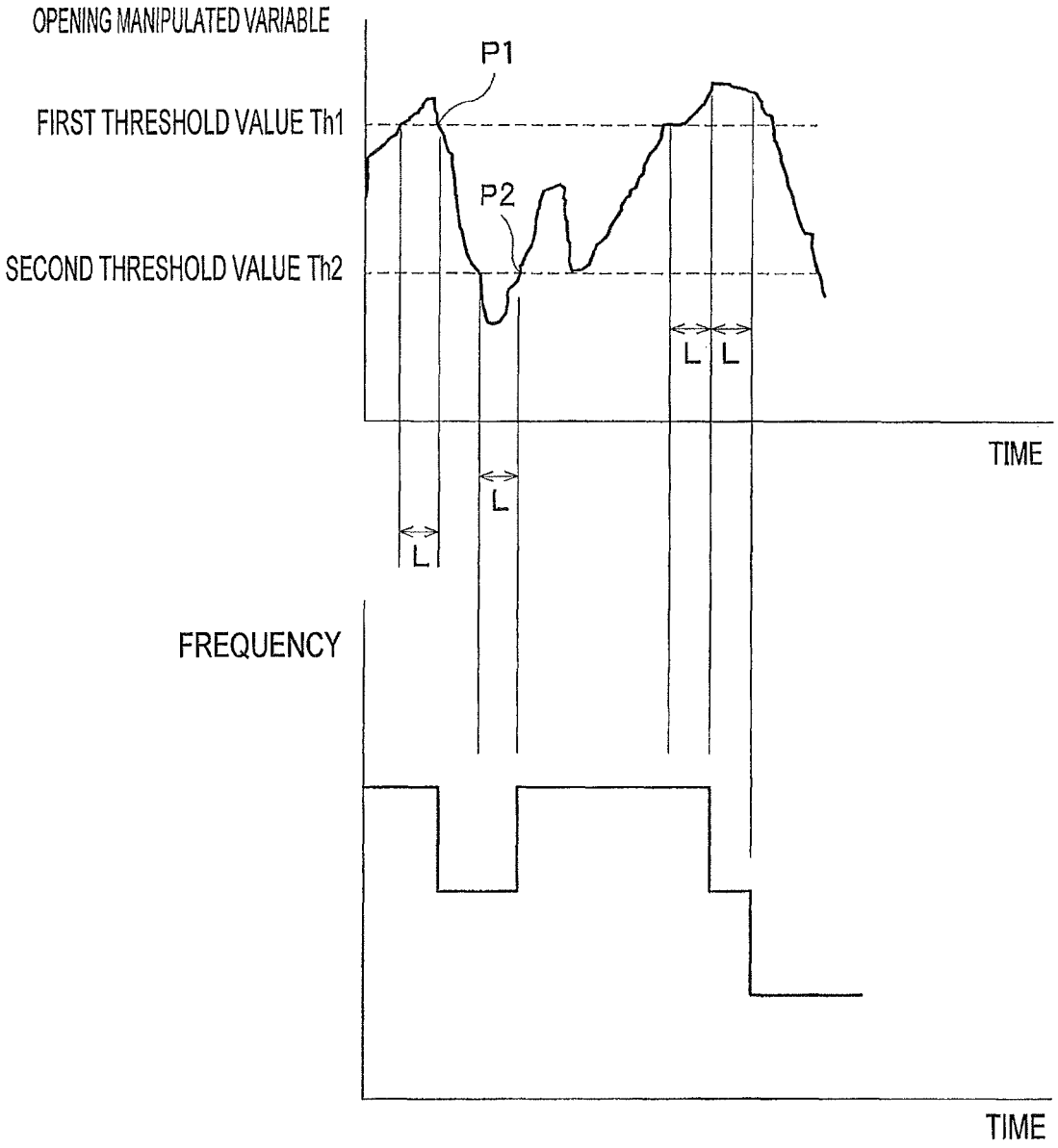
FIG. 3 is a view showing a graph for explaining a condition of an opening manipulated variable and a state of an operating frequency of a compressor that is controlled in accordance with the opening manipulated variable.

FIG. 3 shows a graph that explains an example of the control of the operating frequency of the compressor 1 by the compressor control part 52. In FIG. 3, the upper graph shows a temporal change of the opening manipulated variable of the thermal dose control part 51, and the lower graph shows a temporal change of the operating frequency of the compressor 11 in accordance with the opening manipulated variable.

In FIG. 3, at a point P1 where the opening manipulated variable of the the thermal dose adjusting valve 22 exceeds the first threshold value Th1 over the predetermined period of time L, the operating frequency of the compressor 11 is decreased by the predetermined frequency. In addition, at a point P2 where the opening manipulated variable of the thermal dose adjusting valve 22 falls below the second threshold value Th2 over the predetermined period of time L, the operating frequency of the compressor 11 is increased by the predetermined frequency. As shown in FIG. 3, in this embodiment, the operating frequency of the compressor 11 is varied in a stepwise manner, taking a relatively long period of time.

Following thereto, the heating medium pressure control part 53 is configured to calculate, by means of a PID calculation based on a difference between a pressure detected by the pressure sensor 44 and a preset target pressure, an opening manipulated variable of the expansion valve 13 for conforming the pressure detected by the pressure sensor 33 to the target pressure, and to control (PID-control) the opening of the expansion valve 13 in accordance with the opening manipulated variable.

In more detail, the heating medium pressure control part in this embodiment outputs the calculated opening manipulated variable to the second pulse converter 56, and the second pulse converter 56 calculates a pulse signal corresponding to the opening operation amount and transmits it to the expansion valve 13. Thus, the opening of the expansion valve 13 is adjusted to the calculated opening manipulated variable. Although not shown, the opening of the expansion valve 13 is adjusted by a stepper motor that is driven in accordance with the pulse signal from the second pulse converter 56.

In addition, the humidification control part 54 is configured to calculate, by means of a PID calculation based on a difference between a humidity detected by the humidity sensor 42 and the preset target humidity, a humidification manipulated variable of the humidifier 70 for conforming the humidity detected by the humidity sensor 42 to the aforementioned target humidity, and to control (PID-control) the humidifier 70 in accordance with the humidification manipulated variable. The humidifier 70 includes, for example, a heater and a tank for storing water to be heated by the heater. In this case, the heater is controlled in accordance with the humidification manipulated variable.

Next, an operation of the air conditioner 1 in this embodiment is described.

In the air conditioner 1 in this embodiment, a target use temperature, which is a target temperature of the use area U, a target pressure of a heating medium in the cooling unit 10, and a target humidity of air whose temperature is to be controlled (temperature control air) are firstly inputted to the controller 50. In addition, the blower 60 is driven so that air in the air passage path 30 flows toward the outlet 32. Thus, the temperature control air is taken in from the inlet 31 of the air passage path 30. Further, the compressor 11 of the cooling unit 10 is driven.

The air taken from the inlet 31 of the air passage path 30 firstly passes through the cooling coil 14 and then passes through the heating coil 21. Thereafter, the air is humidified by the humidifier 70 and is then ejected from the outlet 32 to reach the use area U. At this time, a temperature of the air ejected from the outlet 32 is detected by the first temperature sensor 41, and a humidity thereof is detected by the humidity sensor 42. In addition, a temperature of the use area U is detected by the second temperature sensor 43, and a pressure of the heating medium on the downstream side of the cooling coil is detected by the pressure sensor 44. The first temperature sensor 41 outputs the detected temperature to the controller 50, and the humidity sensor 42 outputs the detected humidity to the controller 50. The second temperature sensor 43 outputs the detected temperature to the controller 50, and the pressure sensor 44 outputs the detected pressure to the controller 50.

In the controller 50, the thermal dose control part 51 sets a target source temperature of the air whose temperature is to be controlled passing through the outlet 32, based on a difference between a temperature detected by the second temperature sensor 43 and the target use temperature preset for the use area U; calculates, by means of a PID calculation based on a difference between a temperature detected by the first temperature sensor 41 and the aforementioned target source temperature, an opening manipulated variable for conforming the temperature detected by the first temperature sensor 41 to the aforementioned target source temperature; and controls the opening of the thermal dose adjusting valve 22 in accordance with the opening manipulated variable.

In addition, the compressor control part 52 adjusts the revolving speed of the compressor 11: by decreasing the operating frequency of the compressor 11 by a predetermined frequency, when the above opening manipulated variable of the thermal dose adjusting valve 22 exceeds a first threshold value over a predetermined period of time; and by increasing the operating frequency of the compressor 11 by the predetermined frequency, when the above opening manipulated variable of the thermal dose adjusting valve 22 falls below a second value, which is smaller than the first threshold value, over the predetermined period of time.

In addition, the heating medium pressure control part 53 calculates, by means of a PID calculation based on a difference between a pressure detected by the pressure sensor 44 and the preset target pressure, an opening manipulated variable of the expansion valve 13 for conforming the pressure detected by the pressure sensor 44 to the aforementioned target pressure, and controls the opening of the expansion valve 13 in accordance with the opening manipulated variable.

Further, the humidification control part 54 calculates, by means of a PID calculation based on a difference between a humidity detected by the humidity sensor 42 and the preset target humidity, a humidification manipulated variable of the humidifier 70 for conforming the humidity detected by the humidity sensor 42 to the aforementioned target humidity, and controls the humidifier 70 in accordance with the humidification manipulated variable.

Due to the above control operations of the thermal dose control part 51, the compressor control part 52, the heating medium pressure control part 53 and the humidification control part 54, the temperature of the use area U is controlled toward the target use temperature, and the humidity of the air is controlled toward the target humidity.

According to the above-described air conditioner 1 in this embodiment, by employing the compressor 11 which is operated by a variable operating frequency so that a revolving speed thereof is adjustable, the revolving speed of the compressor 11 can be varied. Thus, even under conditions of a usage environment and target temperatures (target use temperature, target source temperature) that are broadly set, a sufficiently broad cooling capacity for controlling a temperature of air whose temperature is to be controlled toward a target temperature can be obtained by the single compressor 11. In addition, when the cooling capacity is not so needed, power can be saved by decreasing the operating frequency. Thus, the air conditioner can be small and simple and is capable of saving power while being suited for greater service conditions.

The heating unit 20 employs the structure configured to cause a part of the heating medium flowing out from the compressor 11 toward the condenser 12 to diverge and to cause it to return to flow into the condenser 12 on the downstream side of the compressor 11 through the heating coil 21 and the thermal dose adjusting valve 22 disposed on the downstream side thereof. Thus, the accuracy in controlling a temperature to a target temperature can be improved, and the air conditioner can be simplified as a whole because of the simple thermal does adjusting valve 22.

Namely, unlike this embodiment, when a valve for adjusting a flow rate is disposed on the upstream side of the heating coil 21, the valve controls the gaseous heating medium having a high temperature and a high pressure, coming from the compressor 11. It is more difficult to accurately control a flow rate of a gaseous heating medium than to control a flow rate of a liquid heating medium. Moreover, a robust structure that can withstand a high-temperature and high-pressure heating medium is needed. On the other hand, in this embodiment, since the thermal dose adjusting valve 22 is disposed on the downstream side of the heating coil 21, the thermal dose adjusting valve 22 can control a flow rate of the heating medium that has passed through the heating coil 21 so as to be liquefied. Furthermore, since the heating medium has a lowered temperature, even the thermal dose adjusting valve of a relatively simple structure can withstand the temperature of the heating medium. Thus, the accuracy in controlling a temperature to a target temperature can be improved, and the air conditioner can be simplified as a whole because of the simple thermal does adjusting valve 22.

In addition, according to the structure in which a part of the heating medium having passed through the heating coil 21 is returned to the downstream side of the compressor 11 (upstream side of the condenser 12), the heating medium, which has passed through the heating coil 21 so as to be liquefied, returns to the condenser 12. Thus, the heating medium, which has passed through the heating coil 21 so as to be liquefied, can be prevented from flowing into the compressor 11, whereby the air conditioner can be smoothly operated. As a result, the accuracy in controlling a temperature to a target temperature can be improved.

Namely, unlike this embodiment, when the heating medium, which has passed through the heating coil 21 so as to be liquefied, flows into the compressor 11, a so-called liquid back phenomenon occurs. In the liquid back phenomenon, a lubrication oil supplied to a movable part in the compressor 11 may flow out, which invites seizure. In addition, since the compressor 11 compresses the liquid, the operation stability of the compressor 11 may be impaired. On the other hand, in this embodiment, since the heating medium is returned to the downstream side of the compressor 11, it is possible to prevent the seizure of a member in the compressor 11 and the unstable operation of the compressor 11. As a result, the air conditioner can be smoothly operated, whereby the accuracy in controlling a temperature to a target temperature can be improved.

In addition, the thermal dose control part 51 sets a target source temperature of the air whose temperature is to be controlled passing through the outlet 32, based on a difference between a temperature detected by the second temperature sensor 43 and a target use temperature preset for the use area U; calculates, by means of a PID calculation based on a difference between a temperature detected by the first temperature sensor 41 and the target source temperature, an opening manipulated variable of the thermal dose adjusting valve 22 for conforming the temperature detected by the first temperature sensor 41 to the target source temperature; and controls the opening of the thermal dose adjusting valve 22 in accordance with the opening manipulated variable. Thus, by taking into consideration of influences of disturbance and responsibility when the temperature control air having passed through the outlet 32 reaches the use area U, it is possible to obtain a right opening manipulated variable of the thermal dose adjusting valve 22 for conforming a temperature of the use area U to the target use temperature by means of the temperature control air. Thus, the accuracy in controlling a temperature to a target temperature (target use temperature) can be improved.

In addition, the compressor control part 52 adjusts the revolving speed of the compressor 11; by decreasing the operating frequency of the compressor 11 by a predetermined frequency, when the opening manipulated variable of the thermal dose adjusting valve 22 exceeds the first threshold value Th1 over the predetermined period of time L; and by increasing the operating frequency of the compressor 11 by the predetermined frequency, when the opening manipulated variable of the thermal dose adjusting valve 22 falls below the second value Th2, which is smaller than the first threshold value Th1, over the predetermined period of time L. Thus, when the opening manipulated variable of the thermal dose adjusting valve 22 exceeds the first threshold value Th1 over the predetermined period of time L, the compressor control part 52 judges that the cooling capacity is excessive, and the compressor control part 52 decreases the operating frequency of the compressor 11 to decrease the revolving speed, whereby the cooling capacity can be decreased. On the other hand, when the opening manipulated variable of the thermal dose adjusting valve 22 falls below the second threshold value Th2, which is smaller than the first threshold value Th1, over the predetermined period of time L, the compressor control part 52 judges that the cooling capacity is insufficient and increases the operating frequency of the compressor 11 to increase the revolving speed, whereby the cooling capacity can be increased. Thus, a temperature of air whose temperature is to be controlled can be appropriately controlled.

In particular, since whether to increase or decrease the operating frequency of the compressor 11 is judged based on a behavior of the opening manipulated variable of the thermal dose adjusting valve 22 in the predetermined period of time L after the predetermined period of time L has elapsed, the operating frequency of the compressor 11 is varied in a stepwise manner, and the operating frequency can be prevented from being abruptly varied. Thus, a disturbance influence caused by variation in cooling capacity and heating capacity in accordance with the variation in operating frequency can be restrained. Thus, the accuracy in controlling a temperature to a target temperature can be improved.

In addition, the heating medium pressure control part 53 calculates, by means of a PID calculation based on a difference between a pressure detected by the pressure sensor 44*r* and a preset target pressure, an opening manipulated variable of the expansion valve for conforming the pressure detected by the pressure sensor 44 to the target pressure, and controls the opening of the expansion valve 13 in accordance with the opening manipulated variable. Thus, since the temperature of the heating medium flowing out from the cooling coil 14 can be stabilized, the cooling capacity is made stable. Thus, the accuracy in controlling a temperature to a target temperature can be improved.

For the foregoing reasons, according to this embodiment, by utilizing the compressor 11 which is operated at a variable operating frequency so that a revolving speed thereof is adjustable, it is possible to achieve an air conditioner being capable of being reduced in size, of being simplified and of saving power while being suited for wide range of service conditions, on the other hand, the air conditioner being capable of controlling a temperature of air to be controlled to a desired temperature with a high degree of accuracy. The inventors of the present invention confirmed that, when the air conditioner 1 according to this embodiment was operated under certain conditions, the temperature of the use area U could be controlled within an error range of between +0.03° C. and −0.03° C. of the target use temperature.

Although one embodiment of the present invention has been described above, the present invention is not limited to the aforementioned embodiment.

1 Air conditioner
10 Cooling unit
11 Compressor
12 Condenser
13 Expansion valve
14 Cooling coil
15 Pipe
15A Pipe
20 Heating unit
21 Heating coil
22 Thermal dose adjusting valve
25 Supply pipe
26 Return pipe
30 Air passage path
31 Inlet
32 Outlet
41 First temperature sensor
42 Humidity sensor
43 Second temperature sensor
44 Pressure sensor
50 Control unit
51 Thermal dose control part
52 Compressor control part
53 Heating medium pressure control part
54 Humidification control part
55 First pulse converter
56 Second pulse converter

60 Blower
70 Humidifier
U Use area

What is claimed is:

1. An air conditioner comprising:

a cooling unit in which a compressor which is operated at a variable operating frequency so that a revolving speed thereof is adjustable, a condenser, an expansion valve, and a cooling coil are connected in this order by pipes in order to circulate a heating medium;

a heating unit which causes a part of the heating medium flowing out from the compressor toward the condenser to diverge through a heating coil and a thermal dose adjusting valve, wherein the thermal dose adjusting valve is disposed on the downstream side of the heating coil, wherein the part of the heating medium returns from the heating coil to flow into the condenser on a downstream side of the compressor;

an air passage path which accommodates the cooling coil and the heating coil, and wherein the air passage is provided with an inlet for taking in an air whose temperature is to be controlled, and an outlet for ejecting the air whose temperature is to be controlled;

a blower which causes air to flow from the inlet to the outlet;

a first temperature sensor disposed on the outlet; and a controller which controls the operating frequency of the compressor and an opening of the thermal dose adjusting valve;

wherein the controller includes:

a thermal dose control part which sets a target source temperature of the air whose temperature is to be controlled passing through the outlet; calculates, by means of a PID calculation based on a difference between a temperature detected by the first temperature sensor and the target source temperature, an opening manipulated variable of the thermal dose adjusting valve for conforming the temperature detected by the first temperature sensor to the target source temperature; and controls the opening of the thermal dose adjusting valve in accordance with the opening manipulated variable; and a compressor control part which adjusts the revolving speed of the compressor; by decreasing the operating frequency of the compressor by a predetermined frequency when the opening manipulated variable of the thermal dose adjusting valve, which is calculated by the thermal dose control part, exceeds a first threshold value over a predetermined period of time which is set between 10 seconds and 30 seconds; and by increasing the operating frequency of the compressor by the predetermined frequency when the opening manipulated variable of the thermal dose adjusting valve, which is calculated by the thermal dose control part, falls below a second threshold value, which is smaller than the first threshold value, over the predetermined period of time.

2. The air conditioner according to claim 1, further comprising:

a second temperature sensor disposed in a use area to which air ejected from the outlet is supplied; and wherein the controller sets the target source temperature based on a difference between a temperature detected by the second temperature sensor and a target use temperature preset for the use area.

3. The air conditioner according to claim 1, further comprising:

a pressure sensor which detects a pressure in the pipe on the downstream side of the cooling coil; wherein the controller further controls an opening of the expansion valve; and the controller further includes a heating medium pressure control part which calculates, by means of a PID calculation based on a difference between a pressure detected by the pressure sensor and a preset target pressure, an opening manipulated variable of the expansion valve for conforming the pressure detected by the pressure sensor to the target pressure, and controls the opening of the expansion valve in accordance with the opening manipulated variable.

4. The air conditioner according to claim 1, wherein the thermal dose control part calculates, as the opening manipulated variable of the thermal dose adjusting valve, a moving average value of the manipulated variable calculation values of the thermal dose adjusting valve, which are directly calculated by means of the PID calculation based on the difference between the temperature detected by the first temperature sensor and the target source temperature, with an interval at which the moving average value is shorter than the predetermined period of time.

5. The air conditioner according to claim 4, wherein the interval at which the moving average value is set in a range of from 1/10 to 6/10 of the predetermined period of time.

6. The air conditioner according to claim 1, further comprising:

a humidifier which adjusts a humidity of the air whose temperature is to be controlled, the humidifier being disposed on the downstream side of the heating coil in the air passage path; and a humidity sensor disposed on the outlet;

wherein the controller further includes a humidification control part which calculates, by means of a PID calculation based on a difference between a humidity detected by the humidity sensor and a preset target humidity, a humidification manipulated variable for conforming the humidity detected by the humidity sensor to the target humidity, and controls the humidifier in accordance with the humidification manipulated variable.

7. An air conditioner operating method, the air conditioner comprising: a cooling unit in which a compressor which is operated at a variable operating frequency so that a revolving speed thereof is adjustable, a condenser, an expansion valve, and a cooling coil are connected in this order by pipes in order to circulate a heating medium; a heating unit which causes a part of the heating medium flowing out from the compressor toward the condenser to diverge through a heating coil and a thermal dose adjusting valve, wherein the thermal dose adjusting valve is disposed on a downstream side of the heating coil, and wherein the part of the heating medium returns from the heating coil to flow into the condenser on a downstream side of the compressor; an air passage path which accommodates the cooling coil and the heating coil, and wherein the air passage is provided with an inlet for taking in an air whose temperature is to be controlled, and an outlet for ejecting the air whose temperature is to be controlled; a blower which causes air to flow from the inlet to the outlet; and a first temperature sensor disposed on the outlet;

the air conditioner operating method comprising:

a thermal dose control step which sets a target source temperature of the air whose temperature is to be controlled passing through outlet; calculates, by means of a PID calculation based on a difference between a temperature detected by the first temperature sensor and the target source temperature, an opening manipulated variable of the thermal dose adjusting valve for conforming the temperature detected by the first temperature sensor to the target source temperature; and controls the opening of the thermal dose adjusting valve in accordance with the opening manipulated variable; and a compressor control step which adjusts the revolving speed of the compressor; by decreasing the operating frequency of the compressor by a predetermined frequency when the opening manipulated variable of the thermal dose adjusting valve, which is calculated in the thermal dose control step, exceeds a first threshold value over a predetermined period of time which is set between 10 seconds and 30 seconds; and by increasing the operating frequency of the compressor by the predetermined frequency when the opening manipulated variable of the thermal dose adjusting valve, which is calculated is the thermal dose control step, falls below a second threshold value, which is smaller than the first threshold value, over the predetermined period of time.

8. The air conditioner operating method according to claim 7, wherein the air conditioner further comprises a second temperature sensor disposed in a use area to which air ejected from the outlet is supplied; and the thermal dose control step sets the target source temperature based on a difference between a temperature detected by the second temperature sensor and a target use temperature preset for the use area.

9. The air conditioner operating method according to claim 7, further comprising a heating medium pressure control step which calculates, by means of a PID calculation based on a difference between a pressure detected by a pressure sensor, which detects a pressure in the pipe on the downstream side of the cooling coil in the air passage path, and a preset target pressure, an opening manipulated variable of the expansion valve for conforming the pressure detected by the pressure sensor to the target pressure, and controls the opening of the expansion valve in accordance with the opening manipulated variable.

10. The air conditioner operating method according to claim 7, wherein the thermal dose control step calculates, as the opening manipulated variable of the thermal dose adjusting valve, a moving average value of the manipulated variable calculation values of the thermal dose adjusting valve, which are directly calculated by means of the PID calculation based on the difference between the temperature detected by the first temperature sensor and the target source temperature, with an interval at which the moving average value is shorter than the predetermined period of time.

11. The air conditioner operating method according to claim 10, wherein the interval at which the moving average value is set in a range of from 1/10 to 6/10 of the predetermined period of time.

12. The air conditioner operating method according to claim 7, wherein the air conditioner is provided with a humidifier which adjusts a humidity of the air whose temperature is to be controlled, on the downstream side of the heating coil in the air passage path, and the air conditioner operating method further comprises a humidification control step which calculates, by means of a PID calculation based on a difference between a humidity detected by a humidity sensor disposed on the outlet and a preset target humidity, a humidification manipulated variable of the humidifier for conforming the humidity detected by the humidity sensor to the target humidity, and controls the humidifier in accordance with the humidification manipulated variable.

* * * * *